US007494185B2

(12) United States Patent
Boyer

(10) Patent No.: US 7,494,185 B2
(45) Date of Patent: Feb. 24, 2009

(54) J-BACK ADJUSTMENT MECHANISM

(75) Inventor: Earl Boyer, Spring Lake, MI (US)

(73) Assignee: L & P Property Management Company, South Gate, CA (US)

( * ) Notice: Subject to any disclaimer, the term of this patent is extended or adjusted under 35 U.S.C. 154(b) by 425 days.

(21) Appl. No.: 11/210,298

(22) Filed: Aug. 24, 2005

(65) Prior Publication Data

US 2006/0055221 A1 Mar. 16, 2006

Related U.S. Application Data

(60) Provisional application No. 60/604,676, filed on Aug. 26, 2004.

(51) Int. Cl.
*B60N 2/02* (2006.01)

(52) U.S. Cl. ..... 297/353; 297/300.7; 297/301.7; 297/301.1; 297/301.5

(58) Field of Classification Search ..... 297/301.1, 297/301.2, 301.3, 301.4, 301.5, 301.6, 301.7, 297/300.7, 353
See application file for complete search history.

(56) References Cited

U.S. PATENT DOCUMENTS 2,272,980 A * 2/1942 McLellan et al. ..... 297/362.14
5,658,045 A * 8/1997 Van Koolwijk et al. .. 297/300.5
5,725,276 A * 3/1998 Ginat ..... 297/289
5,951,109 A * 9/1999 Roslund et al. ..... 297/383
6,213,552 B1 4/2001 Miotto
6,367,877 B1 * 4/2002 Knoblock et al. ..... 297/301.1
6,572,191 B2 * 6/2003 Wild ..... 297/301.4
6,659,554 B2 * 12/2003 Su ..... 297/301.3
6,685,267 B1 * 2/2004 Johnson et al. ..... 297/300.1
7,185,951 B2 * 3/2007 Johnson et al. ..... 297/343

FOREIGN PATENT DOCUMENTS

WO PCT/US2005/030268 3/2006

* cited by examiner

*Primary Examiner*—David Dunn
*Assistant Examiner*—Erika Garrett
(74) *Attorney, Agent, or Firm*—Shook, Hardy & Bacon, L.L.P.

(57) ABSTRACT

An adjustment mechanism for use with a chair. The adjustment mechanism is for use on a chair that has a base assembly with an extending pedestal, a seat, a chassis, and a back. Specifically the adjustment mechanism is for use on a chair that utilizes a J-back bar that couples the chassis to the back. The J-back adjustment mechanism allows the angle of the J-back bar and thus, the back to be changed throughout a range of motion. The J-back adjustment assembly includes a casing and an adjustment portion, wherein rotation of the adjustment portion changes the inclination of the J-back bar and, thus, the back with respect to the seat.

17 Claims, 3 Drawing Sheets

J-BACK ADJUSTMENT MECHANISM

CROSS-REFERENCE TO RELATED APPLICATIONS

This application claims the benefit of U.S. Provisional Application No. 60/604,676, filed Aug. 26, 2004.

STATEMENT REGARDING FEDERALLY SPONSORED RESEARCH OR DEVELOPMENT

Not applicable.

BACKGROUND

This invention relates to an adjustment mechanism for use in office furniture. More specifically, the invention relates to an adjustment mechanism for use in adjusting the angle of a J-back support on office chairs.

One style of office chairs includes a back that is supported by a J-shaped bar, called a J-back support bar. In these office chairs, the J-back support bar is supported by and connected to the mechanism that controls the recline, seat height, etc. This item is typically referred to simply as a mechanism. The angle of the J-back support bar is dictated by its connection to this mechanism. However, it would be desirable for the angle of the J-back support bar to be adjustable. Moreover, it would be desirable if the adjustability of the J-back support bar could be provided on existing mechanisms where the J-back support bar was not previously adjustable.

Accordingly, the present invention provides an adjustment assembly that allows the angle of the J-back to be changed throughout a range of motion. The assembly utilizes two opposed wedges to vertically move the end portion of a J-back about a pivot point. As the end portion of the J-back support bar moves upwardly or downwardly, the angle of the back attached to the J-back support bar changes with respect to the chair seat.

SUMMARY

This invention is directed to a J-back adjustment mechanism for use with a chair. The J-back adjustment mechanism is for use on a chair that has a base assembly with an extending pedestal, a seat, a chassis, and a back. Specifically the J-back adjustment mechanism is for use on a chair that utilizes a J-back bar that couples the chassis to the back. The J-back adjustment mechanism allows the angle of the J-back bar and thus, the back to be changed throughout a range of motion. The J-back adjustment assembly includes a casing and an adjustment portion. The casing includes a top retainer and a U-bracket that are coupled to house the adjustment portion. Once assembled, the retainer and U-bracket create a receiving slot for the J-back support bar. The J-back support bar is coupled to the casing by a pair of apertures.

The adjustment portion is housed in the casing and includes a tilt wedge, a slide wedge, an adjusting shaft, and an adjusting knob. The tilt wedge includes a plurality of angled surfaces and a J-back receiving slot. The slide wedge contains a plurality of sliding surfaces that are angled and designed to mate with the angled surfaces of the tilt wedge. Additionally, the slide wedge includes a shaft receiving threaded bore. This bore couples the slide wedge to the adjusting shaft. Turning the adjusting shaft via the knob translates into lateral movement of the slide wedge which, in turn, translates into vertical movement of the tilt wedge. The vertical movement of the tilt wedge vertically moves the end portion of the J-back bar about a pivot point. As the end portion moves upwardly or downwardly, the angle of the back attached to the J-back support bar changes its angle with respect to the chair seat.

Additional advantages and novel features of the invention will be set forth in part in a description which follows and will become apparent to those skilled in the art upon examination of the following, or may be learned by practice of the invention.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
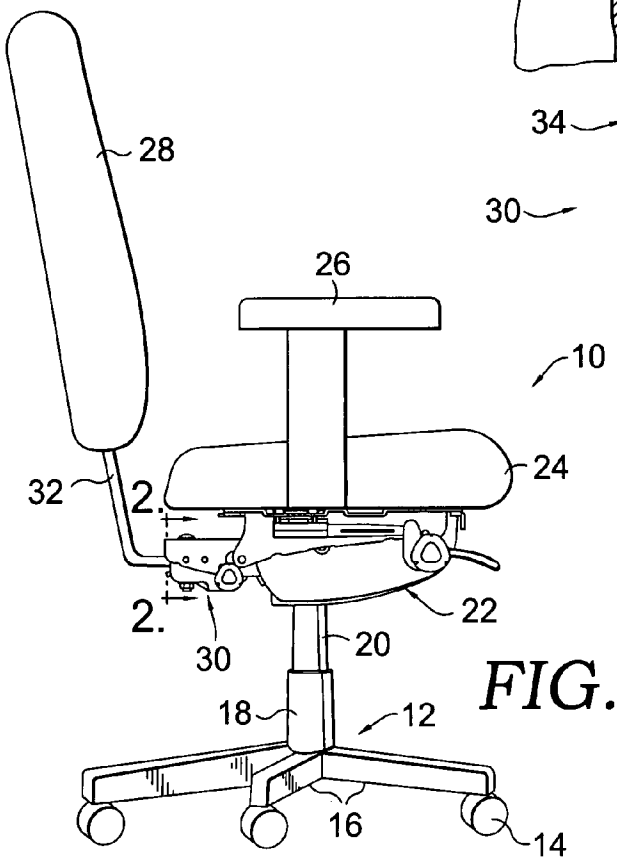
FIG. 1 is a perspective view of a chair with a J-back adjustment assembly.

With initial reference to FIG. 1, a chair embodying the principles of the invention is generally indicated by reference numeral 10. The chair 10 is equipped with a base assembly 12. The base 12 preferably has a number of castors 14 operably supported on the outer ends of a corresponding number of support legs 16. The support legs 16 converge to a pedestal column 18. Preferably, the pedestal column 18 and the support legs 16 are integrally formed in one piece. The column 18 preferably supports a gas cylinder 20. The gas cylinder 20 allows the height of the chair 10 to be adjusted by an occupant, as is known to those of skill in the art. The construction of the base 12, column 18, and gas cylinder 20 is well known to those of skill in the chair industry.

With continued reference to FIG. 1, a chassis 22 is coupled to the gas cylinder 20. The chassis 22 supports a seat 24 that is slidingly coupled to the chassis 22. The chassis 22 includes a hole in its bottom, not shown, that accommodates an upper portion of gas cylinder 20. The upper portion of cylinder 20 is then secured to chassis 22 so that as the cylinder 20 extends and retracts, the chassis 22 correspondingly moves up and down. Preferably, this coupling is accomplished via a tapered bushing, as is known to those of skill in the art. A pair of armrests 26 and a chair back 28 are also coupled to the seat 24. Coupling of the chair back 28 to the seat 24 is accomplished by a J-back adjustment mechanism 30 and a J-back support bar 32.

Figure 2:
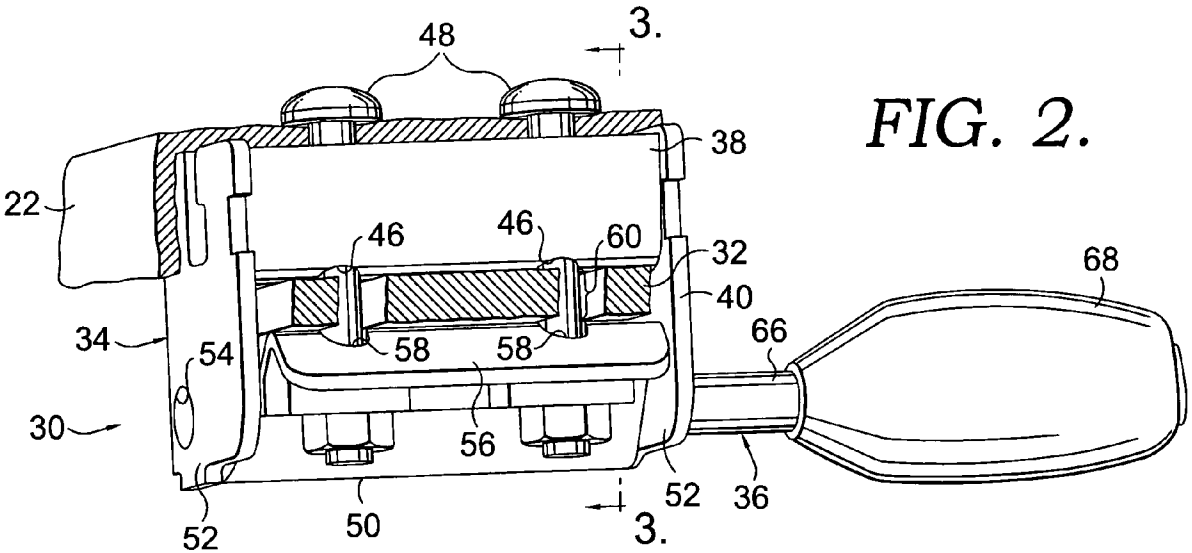
FIG. 2 is a rear perspective view of the J-back adjustment assembly of FIG. 1, taken along the line 2-2.
Figure 3:
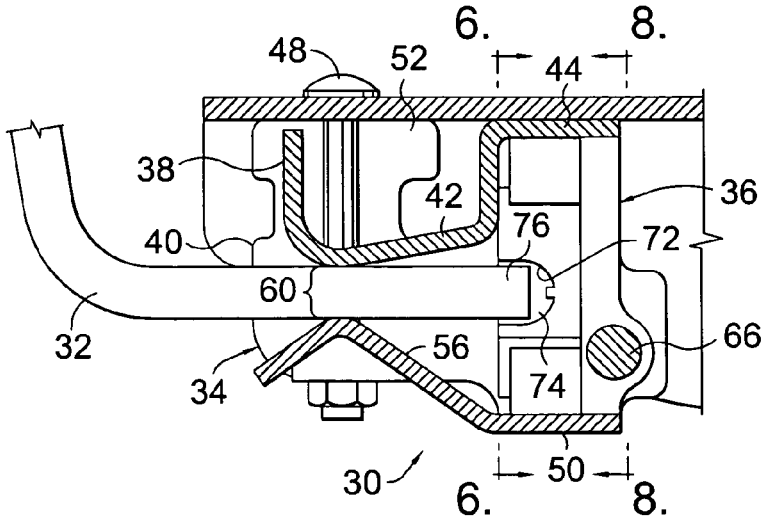
FIG. 3 is a cross-sectional view of the J-back adjustment assembly of FIG. 2, taken along the line 3-3.

Referring now to FIGS. 1 and 2, the J-back adjustment mechanism 30 will be discussed. As stated above the J-back adjustment mechanism 30 is typically used to couple the chair back 28 to the chassis 22 or the seat 24. Specifically, as seen in FIGS. 2 and 3, the J-back adjustment mechanism 30 includes a weldment casing 34 and an adjustment portion 36.

The casing 34 includes a top retainer 38 and a U-bracket 40. The retainer 38 is shaped as shown and includes a bend portion 42 and top plate 44. The bend portion 42 is U-shaped and depends from the top plate 44. The bend portion 42 and top plate 44 may be integral or formed from two separate pieces and welded together. The bend portion 42 contains a pair of apertures 46 that receive a pair of bolts 48 to connect the casing 34 to the chassis 22. The U-bracket 40 is shaped as shown and includes a central mounting portion 50 and a pair of sidewalls 52 that depend upwardly therefrom. The sidewalls 52 contain a pair of apertures 54 used to mount the adjustment portion 36 as will be discussed further below. The central mounting portion 50 is shaped as shown and contains a curved portion 56 with a pair of apertures 58.

The top retainer 38 and U-bracket 40 are coupled as shown in FIG. 2. Preferably the two pieces are coupled by welding, as shown. After welding, the top retainer 38 and U-bracket 40 make up the casing 34. Once assembled, the apertures 46 of the bend portion 42 of the top retainer 38 align with the apertures 58 of the mounting portion 50 of the U-bracket 40. Further, as seen in FIGS. 2 and 3, the assembly of the top retainer 38 and U-bracket 40 creates a receiving slot 60 for the J-back support bar 32. The coupling of the J-back support bar 32 to the J-back mechanism 30 will be described below.

Figure 8:
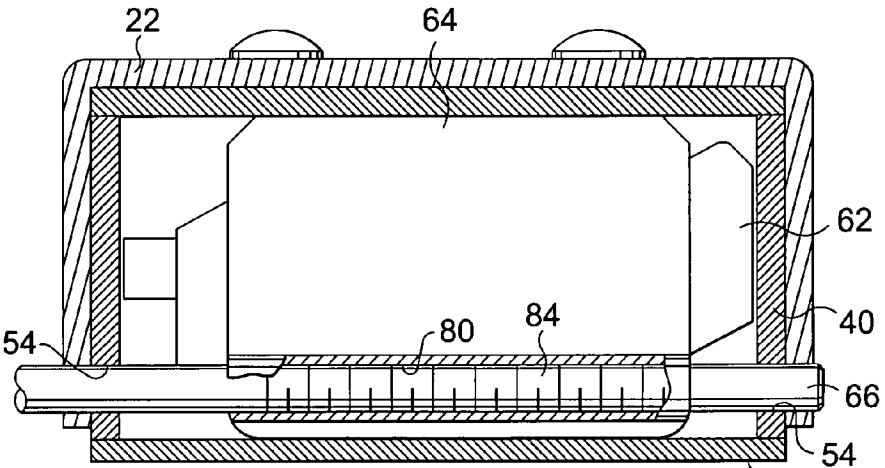
FIG. 8 is a cross-sectional view of the J-back adjustment assembly of FIG. 3, taken along the line 8-8.
Figure 6:
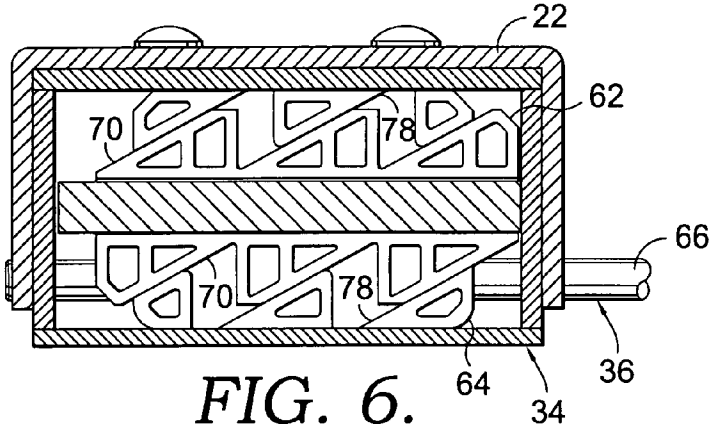
FIG. 6 is a cross-sectional view of the J-back adjustment assembly of FIG. 3, taken along the line 6-6.
Figure 7:
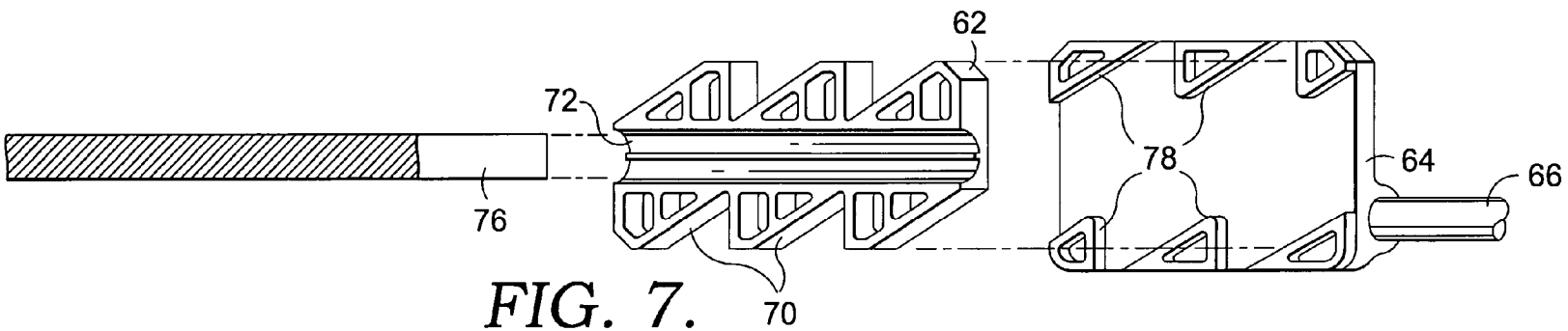
FIG. 7 is a partial, exploded view of the tilt and slide wedges.

Turning now to FIGS. 6-8, the adjustment portion 36 will be discussed. The adjustment portion 36 is housed in the casing 34 and includes a tilt wedge 62, a slide wedge 64, an adjusting shaft 66, and an adjusting knob 68. The tilt wedge 62 includes a plurality of angled surfaces 70 and a J-back receiving slot 72. For the purpose of this discussion plurality means more than one. The J-back receiving slot 72 preferably runs the entire width of tilt wedge 62. As shown in FIG. 3, the slot 72 receives a C-shaped spacer 74. The C-shaped spacer 74 receives an end portion 76 of the J-back support bar 32. As shown in FIGS. 6 and 7, the tilt wedge 62 is configured to align and mate with the slide wedge 64 such that a lateral movement of the slide wedge 64 translates into a vertical movement of the tilt wedge 62. The vertical movement of the tilt wedge 62 causes the J-back support bar 32 received in the C-shaped spacer 74 of the slot to move vertically upwardly or downwardly, as will be further discussed below.

Referring now to FIGS. 6 and 8, the slide wedge 64 will be discussed. As can be seen, the slide wedge 64 contains a plurality of sliding surfaces 78 that are angled and designed to mate with the angled surfaces 70 on the tilt wedge 62. Additionally, the slide wedge 64 includes a threaded bore 80. The bore 80 couples the slide wedge 64 to the adjusting shaft 66. This coupling facilitates movement of the slide wedge 64 with respect to the tilt wedge 62 as will be further discussed below.

Referring now to FIGS. 2 and 8 the adjusting shaft 66 will be discussed. The adjusting shaft 66 is rotatably coupled to the U-bracket 40 at apertures 54. A pair of lever bushings 82, not shown, are included to interface and facilitate movement between the apertures 54 of U-bracket 40 and the adjusting shaft 66. The adjusting shaft 66 has a threaded portion 84 and the adjustment knob 68 is coupled to an end thereof. The threaded portion 84 is received in the threaded bore 80 of the slide wedge 64. Thus, turning the adjusting shaft 66 via the knob 68 translates into lateral movement of the slide wedge 64.

Figure 4:
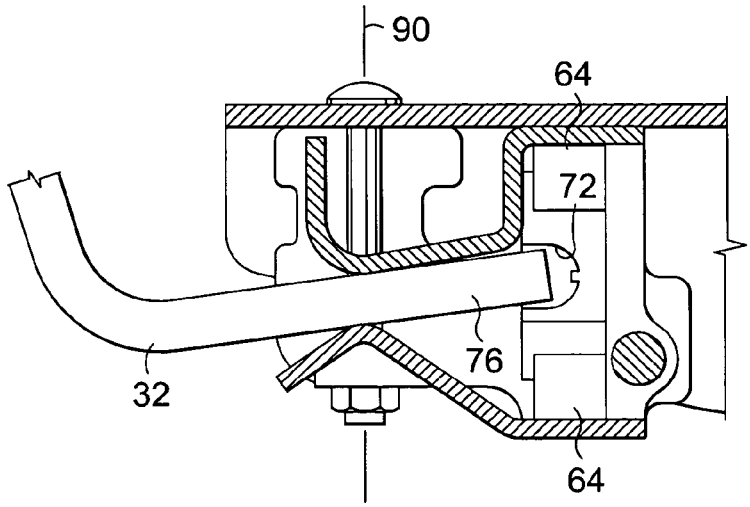
FIG. 4 is a view similar to FIG. 3 but with the J-back adjustment assembly in a reclined position.
Figure 5:
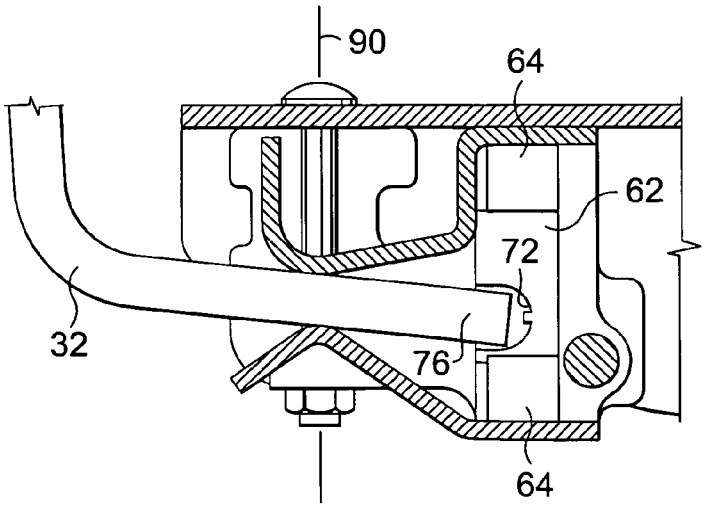
FIG. 5 is a view similar to FIG. 3 but with the J-back adjustment assembly in a generally upright position.

Turning now to FIGS. 2, 3, and 6, the mechanism 30 is formed by inserting the threaded portion 84 of the adjusting shaft 66 into a side of the casing 34. The slide wedge 64 is threaded onto this threaded portion 84 inside the casing 34. The tilt wedge 62 is then placed within casing 34 so that the angled surfaces 70 of the tilt wedge 62 are aligned and mating with the sliding surfaces 78 of the slide wedge 64. The shaft 66 is then secured in place in a second side of the casing 34. The receiving slot 60 is provided between the bend portion 42 of the retainer top 44 and the curved portion 56 of the U-bracket 40 through which the end portion 76 of a J-back support bar 32 can be placed. The end portion 76 of the J-back support bar 32 is received within the C-shaped spacer 74 located in the slot 72. The J-back support bar 32 is then secured in place with the pair of bolts 48 that are received in the apertures 46 located in the bend portion 42 of the retainer top 44 and the curved portion 56 of the U-bracket 40. The bolts 48 protrude downwardly along an axis indicated by line 90, as shown in FIGS. 4 and 5. This line 90 is a pivot point for the J-back support bar 32.

Referring now to FIGS. 3-6 the operation of the mechanism 30 will be discussed. FIG. 3 shows the J-back bar in an intermediate position where the end portion is generally horizontal. FIG. 4 shows the J-back bar in a reclined position. FIG. 5 shows the J-back bar in a generally upright position.

In use, a user can rotate the knob 68, which in turn causes rotation of the adjusting shaft 66. This rotational movement of the adjusting shaft 66 translates into lateral movement of the slide wedge 64. By moving the slide wedge 64, the tilt wedge 62 is also allowed to move. Through the angled surfaces 70, 78 this lateral movement is translated into a vertical movement of slot 72. As slot 72 moves vertically, so does the end 76 of the J-back support bar 32. This pivots the J-back support bar 32 about the axis line 90, which in turn varies the vertical angle of the vertical portion of the J-back support bar 32 to which the chair back 28 is attached. As stated above, FIG. 3 shows the J-back bar in an intermediate position where the end portion 76 is generally horizontal. FIG. 4 shows the J-back bar in a reclined position where the shaft 66 has been turned counterclockwise to laterally displace the slide wedge 64 to move the tilt wedge 62 upwardly. The upward movement of the J-back bar 32 in the slot 72 of the tilt wedge 62 changes the inclination of the J-back bar 32 and, thus, the back 28 with respect to the seat 24. FIG. 5 shows the J-back bar 32 in a generally upright position where the shaft 66 has been turned clockwise to laterally displace the slide wedge 64 to move the tilt wedge 62 downwardly. The downward movement of the J-back bar 32 in the slot 72 of the tilt wedge 62 changes the inclination of the J-back bar 32 and, thus, the back 28 with respect to the seat 24.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. An adjustment mechanism for a chair for adjusting the orientation of a J-back support bar, the mechanism including:

a housing having a receiving slot, the housing being coupled to the chair;

a tilt wedge having a mating surface and a receiving slot;

a slide wedge having a mating surface and a threaded bore; and an adjustment lever threadably received within the threaded bore and rotatably coupled to the housing; and wherein the mating surface of the tilt wedge is aligned with the mating surface of the slide wedge such that rotation of the lever causes lateral movement of the slide wedge and wherein lateral movement of the slide wedge translates into vertical movement of the tilt wedge.

2. The adjustment mechanism of claim 1, wherein the receiving slot of the housing and the tilt wedge align to receive an end of the J-back support bar.

3. The adjustment mechanism of claim 2, wherein the vertical movement of the tilt wedge changes the inclination of the J-back support bar.

4. The adjustment mechanism of claim 3, wherein the mating surface of the tilt wedge has an angled surface.

5. The adjustment mechanism of claim 4, wherein the angled surface has a plurality of angled surfaces.

6. The adjustment mechanism of claim 5, wherein the mating surface of the slide wedge has an angled surface.

7. The adjustment mechanism of claim 6, wherein the angled surface has a plurality of angled surfaces.

8. The adjustment mechanism of claim 7, wherein the housing includes a top retainer and a U-bracket.

9. The adjustment mechanism of claim 2, wherein the receiving slot of the tilt wedge contains a spacer.

10. An adjustment mechanism for a chair having a J-back support bar, the mechanism including:

a housing having a receiving slot, the housing being coupled to the chair;

a means for adjusting the orientation of the J-back support bar containing a tilt wedge having a mating surface and a receiving slot, and a slide wedge having a mating surface and a threaded bore;

an adjustment lever threadably received within the means for adjusting the orientation and rotatably coupled to the housing; and wherein the mating surface of the tilt wedge is aligned with the mating surface of the slide wedge such that rotation of the adjustment lever causes lateral movement of the slide wedge and wherein lateral movement of the slide wedge translates into vertical movement of the tilt wedge, thereby changing the orientation of the J-back support bar.

11. The adjustment mechanism of claim 10, wherein the receiving slot of the housing and the tilt wedge align to receive an end of the J-back support bar.

12. The adjustment mechanism of claim 10, wherein the mating surface of the tilt wedge has an angled surface.

13. The adjustment mechanism of claim 12, wherein the angled surface has a plurality of angled surfaces.

14. The adjustment mechanism of claim 13, wherein the mating surface of the slide wedge has an angled surface.

15. The adjustment mechanism of claim 14, wherein the angled surface has a plurality of angled surfaces.

16. The adjustment mechanism of claim 15, wherein the housing includes a top retainer and a U-bracket.

17. The adjustment mechanism of claim 16, wherein the receiving slot of the tilt wedge contains a spacer.

* * * * *